US010116124B2

(12) United States Patent
Sung et al.

(10) Patent No.: US 10,116,124 B2
(45) Date of Patent: Oct. 30, 2018

(54) ION GENERATOR AND METHOD OF MANUFACTURING THE SAME

(71) Applicant: LG ELECTRONICS INC., Seoul (KR)

(72) Inventors: Bongjo Sung, Changwon-si (KR); Jaesoo Jang, Changwon-si (KR); Ilna Son, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 360 days.

(21) Appl. No.: 15/034,239

(22) PCT Filed: Nov. 7, 2014

(86) PCT No.: PCT/KR2014/010699

§ 371 (c)(1),
(2) Date: May 4, 2016

(87) PCT Pub. No.: WO2015/069066

PCT Pub. Date: May 14, 2015

(65) Prior Publication Data

US 2016/0285243 A1 Sep. 29, 2016

(30) Foreign Application Priority Data

Nov. 7, 2013 (KR) ..... 10-2013-0134951

(51) Int. Cl.
*H01T 23/00* (2006.01)
*H01T 19/04* (2006.01)

(52) U.S. Cl.
CPC ..... *H01T 23/00* (2013.01); *H01T 19/04* (2013.01)

(58) Field of Classification Search
CPC ..... H01T 23/00
See application file for complete search history.

(56) References Cited

U.S. PATENT DOCUMENTS 7,120,007 B2 * 10/2006 Nakasone ..... A61N 1/44 361/231
7,256,979 B2 * 8/2007 Sekoguchi ..... A61L 9/22 361/231

(Continued)

FOREIGN PATENT DOCUMENTS

CN 1749662 3/2006
CN 2800598 7/2006
CN 1847736 10/2006

(Continued)

OTHER PUBLICATIONS

European Search Report dated Jun. 9, 2017 issued in Application No. 14859937.6.

(Continued)

*Primary Examiner* — Stephen W Jackson
(74) *Attorney, Agent, or Firm* — KED & Associates, LLP

(57) ABSTRACT

The present invention comprises: a plastic plate; a copper discharge electrode formed on a first surface of the plastic plate, the copper discharge electrode having at least one discharge needle; a ground electrode formed on an opposite surface of the plastic plate; and a metal coating layer coated on the copper discharge electrode. Thus, reduced manufacturing costs and maximized lifespan are possible.

16 Claims, 5 Drawing Sheets

(56) References Cited

U.S. PATENT DOCUMENTS

| | | | | |
|---|---|---|---|---|
| 7,612,981 | B2 * | 11/2009 | Seto | H01T 23/00 361/230 |
| 2004/0145853 | A1 | 7/2004 | Yoshinori et al. | |

FOREIGN PATENT DOCUMENTS

| | | | |
|---|---|---|---|
| EP | 1 625 890 | | 2/2006 |
| JP | S61-062074 | | 3/1986 |
| JP | H08-310801 | | 11/1996 |
| JP | H10-007405 | | 1/1998 |
| JP | 2001-110547 | | 4/2001 |
| JP | 2003-045611 | | 2/2003 |
| JP | 2003-123940 | | 4/2003 |
| JP | 2003-323964 | | 11/2003 |
| JP | 2004-335411 | A | 11/2004 |
| JP | 2004-363088 | A | 12/2004 |
| JP | 2009-031606 | | 2/2009 |
| JP | 2011-086533 | A | 4/2011 |
| KR | 10-2011-0085607 | A | 7/2011 |
| WO | WO 2011/090295 | | 7/2011 |

OTHER PUBLICATIONS

Japanese Office Action dated Jul. 28, 2017 issued in Application No. 2016-528874.

Chinese Office Action dated Sep. 27, 2016 issued in Application No. 201480061276.9 (with English translation).

International Search Report and Written Opinion dated Feb. 13, 2015 issued in Application No. PCT/KR2014/010699 (full English text).

* cited by examiner

[Fig. 1]
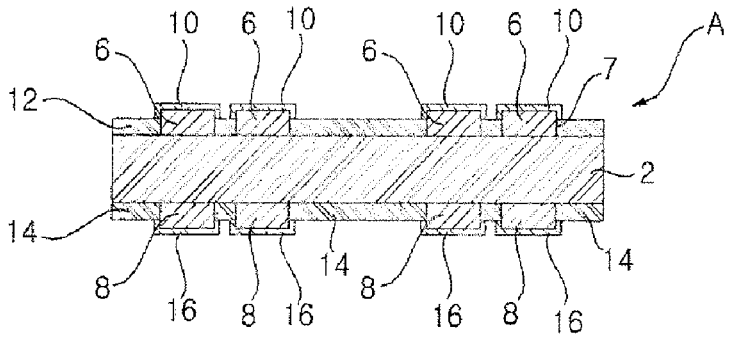
[Fig. 2]
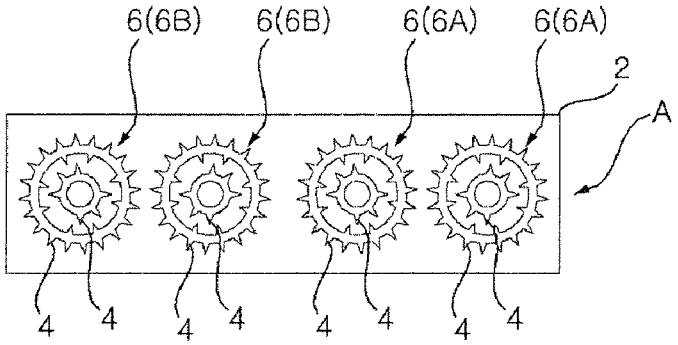
[Fig. 3]
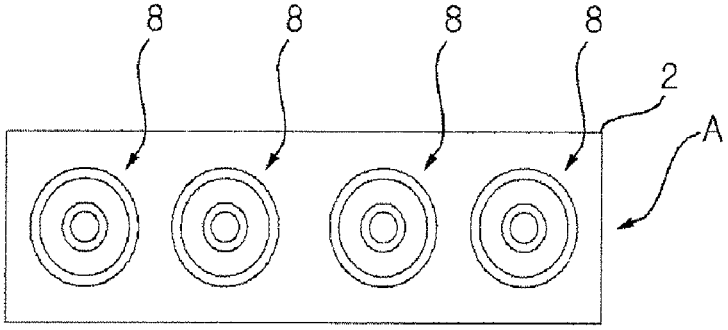

[Fig. 4]
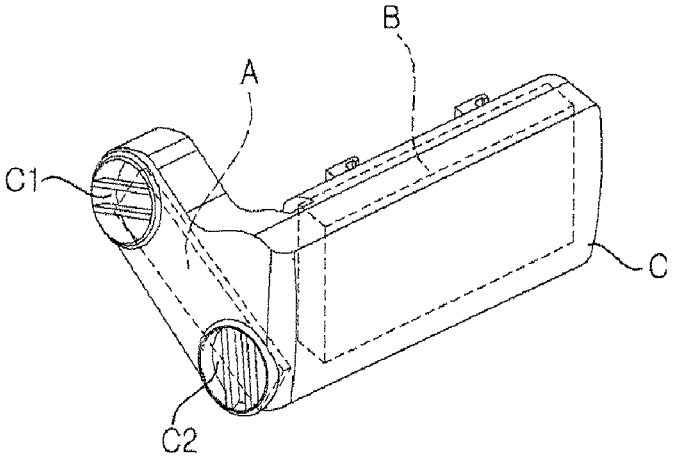
[Fig. 5]
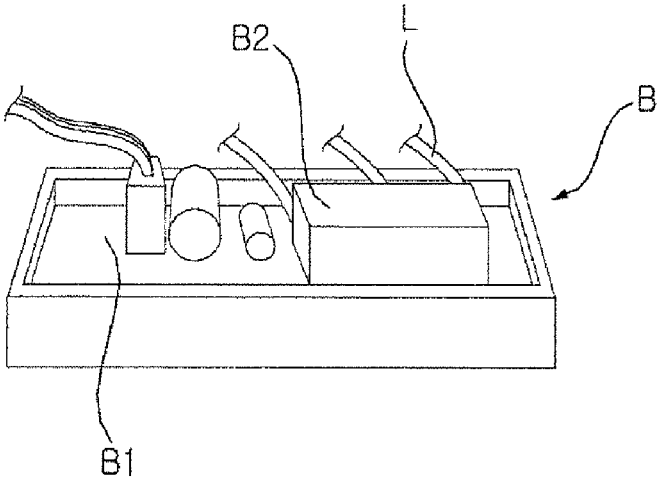

[Fig. 6]
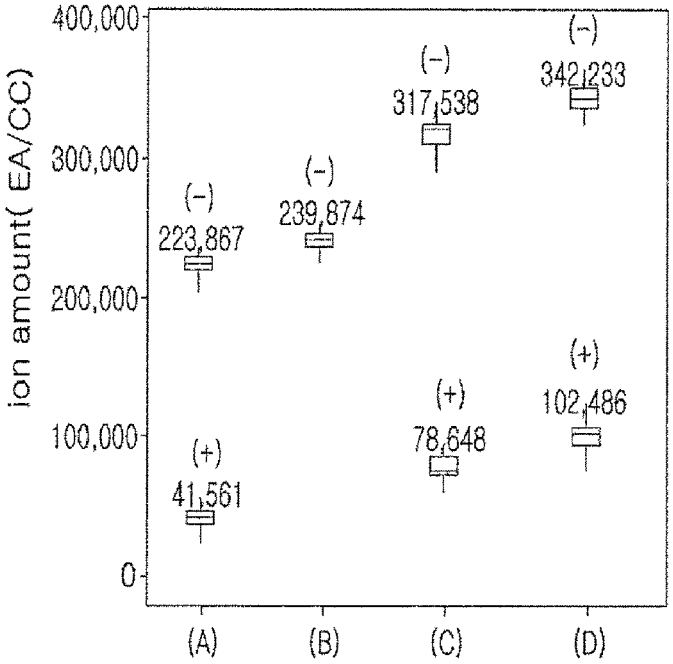
[Fig. 7]
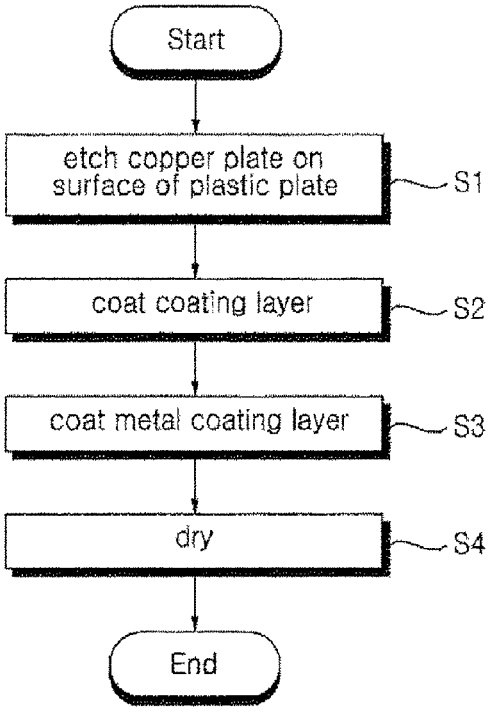

[Fig. 8]
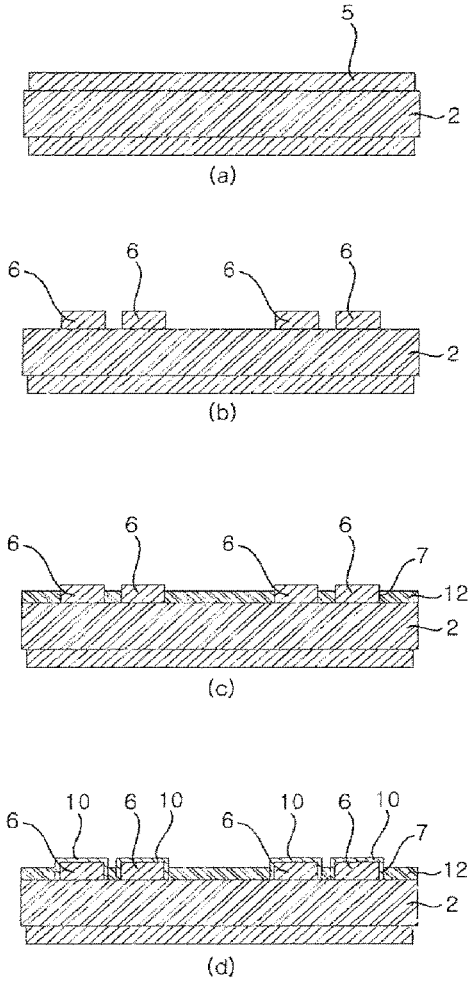
[Fig. 9]
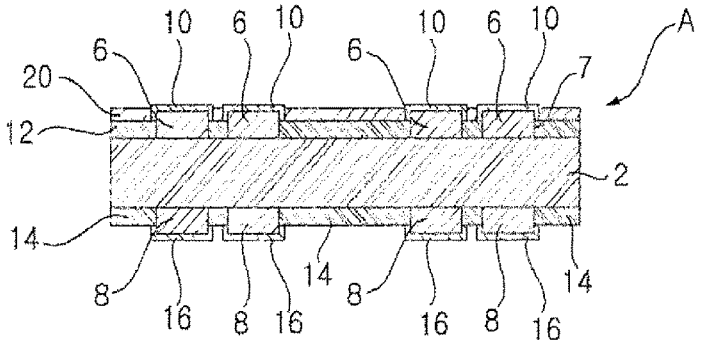

[Fig. 10]
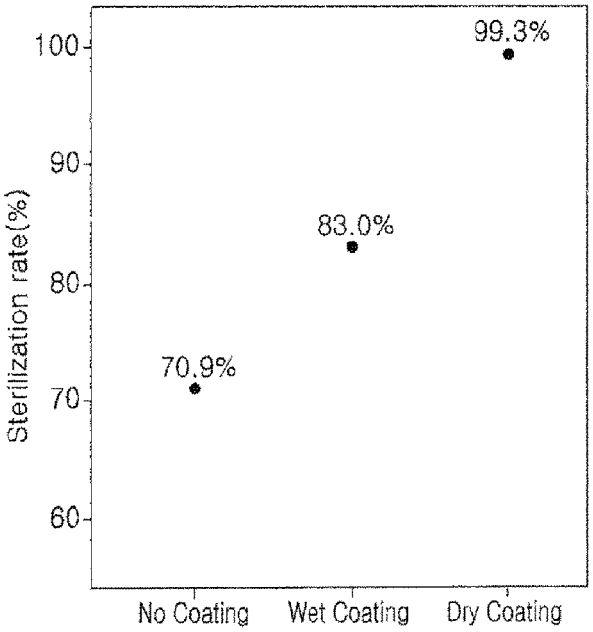
[Fig. 11]
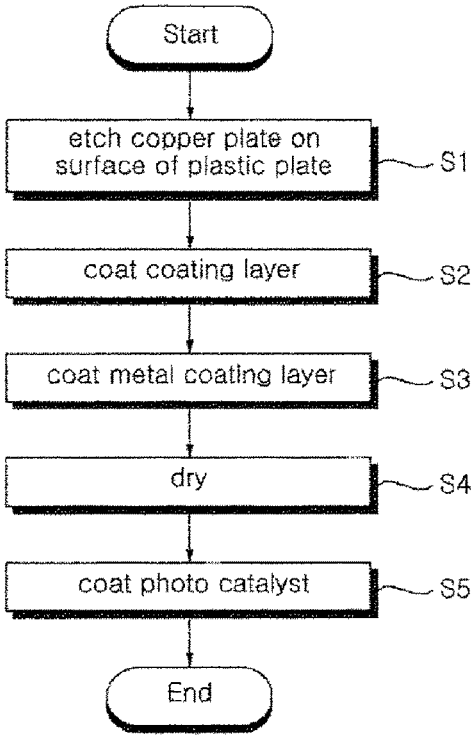

ION GENERATOR AND METHOD OF MANUFACTURING THE SAME

CROSS-REFERENCE TO RELATED PATENT APPLICATIONS

This application is a U.S. National Stage Application under 35 U.S.C. § 371 of PCT Application No. PCT/KR2014/010699, filed Nov. 7, 2014, which claims priority to Korean Patent Application No. 10-2013-0134951, filed Nov. 7, 2013, whose entire disclosures are hereby incorporated by reference.

TECHNICAL FIELD

The present invention relates to an ion generator and a method of manufacturing the same, and particularly, to an ion generator that includes a discharge electrode and a ground electrode and a method of manufacturing the same.

BACKGROUND ART

Generally, the ion generator is a device to generate ions. Ions include negative ions and positive ions. Negative ions mean the state in which, e.g., oxygen or nitrogen molecules include negative electric charges. Negative ions may be beneficial to the human body and have an effect to remove dust or odors.

Recently, various home appliances including hair dryers or water purifiers as well as air conditioners tend to come with an ion generator.

An ion generator may include an ion generating module for generating ions and a high-voltage generator for applying a high voltage to the ion generating module. When the high voltage generator applies a high voltage to the ion generating module, the ion generating module may generate either or both of negative ions and positive ions.

PRIOR ART DOCUMENTS

Patent Documents

KR 10-2013-0068103A (published on Jun. 25, 2013)

DISCLOSURE OF INVENTION

Technical Problem

The ion generators according to the prior art use ceramic material and accordingly suffer from high manufacturing costs and concern for corrosion when the electrodes are oxidized.

Solution to Problem

According to the present invention, an ion generator comprises: a plastic plate; a copper discharge electrode formed on a first surface of the plastic plate, the copper discharge electrode having at least one discharge needle; a ground electrode formed on an opposite surface of the plastic plate; and a metal coating layer coated on the copper discharge electrode.

According to the present invention, an ion generator comprises an ion generating module, a high voltage generator applying a high voltage to the ion generating module, and a housing in which the ion generating module and the high voltage generator are installed, wherein the ion generating module comprises: a plastic plate; a copper discharge electrode formed on a first surface of the plastic plate, the copper discharge electrode having at least one discharge needle; a ground electrode formed on an opposite surface of the plastic plate; and a metal coating layer coated on the copper discharge electrode, and wherein the high voltage generator comprises a printed circuit board, a winding-type transformer formed on the printed circuit board, and a transformer housing formed on the printed circuit board and surrounding the winding-type transformer.

The plastic plate may be formed of epoxy resin.

The metal coating layer may be formed of gold.

The copper discharge electrode may be formed on a portion of the first surface of the plastic plate, and the ground electrode may be formed on a portion of the opposite surface of the plastic plate.

The ion generator may further include a coating layer formed on a portion around the copper discharge electrode on the first surface of the plastic plate.

The ion generator may further comprise a photo catalyst coating layer coated on the coating layer.

According to the present invention, a method of manufacturing an ion generator comprises the steps of: forming a copper discharge electrode by etching a portion of a copper plate formed on a plastic plate; forming a coating layer by ink-coating a portion around the copper discharge electrode; and coating a metal coating layer on the copper discharge electrode.

The ion generator of claim may further comprise drying the ion generator; and coating a photo catalyst on the coating layer.

The step of coating the photo catalyst may be wet-coating the photo catalyst on the coating layer.

The step of coating the photo catalyst may be wet-coating the photo catalyst on the coating layer.

Advantageous Effects of Invention

The present invention may prevent electrodes from being oxidized, thus maximizing the lifespan of the ion generator.

Further, a photo catalyst may be activated by UV (ultra violet) rays generated around the discharge electrode, thus allowing for sterilization and deodorization without a separate UV lamp.

BRIEF DESCRIPTION OF DRAWINGS

FIG. 1 is a cross-sectional view illustrating an ion generator according to an embodiment of the present invention.

FIG. 2 is a view illustrating a surface of an ion generator according to an embodiment of the present invention.

FIG. 3 is a view illustrating another surface of an ion generator according to an embodiment of the present invention.

FIG. 4 is a perspective view illustrating an ion generator according to an embodiment of the present invention.

FIG. 5 is a view illustrating a high voltage generator as shown in FIG. 4.

FIG. 6 is a view illustrating the amount of ions generated from an ion generator according to an embodiment of the present invention.

FIG. 7 is a flowchart illustrating a method of manufacturing an ion generator according to an embodiment of the present invention.

FIG. 8 is a view illustrating a process of manufacturing an ion generator according to an embodiment of the present invention.

FIG. 9 is a cross-sectional view illustrating an ion generator according to another embodiment of the present invention.

FIG. 10 is a view illustrating the sterilization capability of an ion generator according to another embodiment of the present invention.

FIG. 11 is a flowchart illustrating a method of manufacturing an ion generator according to another embodiment of the present invention.

MODE FOR THE INVENTION

Hereinafter, embodiments of the present invention are described in detail with reference to the accompanying drawings.

FIG. 1 is a cross-sectional view illustrating an ion generator according to an embodiment of the present invention. FIG. 2 is a view illustrating a surface of an ion generator according to an embodiment of the present invention. FIG. 3 is a view illustrating another surface of an ion generator according to an embodiment of the present invention.

An ion generator includes a dielectric substrate 2, and discharge electrodes 6 and ground electrodes 8 formed on the dielectric substrate 2, and the ion generator may apply a DC pulse high voltage between the discharge electrode 6 and the ground electrode 8 to generate ions and to oxidize microorganisms. The ion generator may be formed by etching multiple high-density electrodes on the dielectric substrate 2 and then coating the result with a metal (e.g., gold). Accordingly, an electric charge over the electrodes may be kept constant, so that the amount of ions generated from the electrodes may be increased, thus effectively removing microorganisms, e.g., germs, in the air. The dielectric substrate 2 may be a plastic plate that is cheaper than a ceramic material. Hereinafter, an example in which the dielectric substrate 2 is a plastic plate 2 is described, wherein the same reference numeral "2" is used for both the terms "dielectric substrate" and "plastic plate."

The ion generator may include the plastic plate 2; the copper discharge electrodes 6 formed on a surface of the plastic plate 2, each of the copper discharge electrodes 6 having at least one discharge needle 4; the ground electrodes 8 formed on an opposite surface of the plastic plate 2; and a metal coating layer 10 coated on the copper discharge electrodes 6.

The plastic plate 2 may be formed of epoxy resin that is hardened when applied with heat and that is not easily deformed by force. As described below, the plastic plate 2 may offer reliability when dried at high temperature and may function as a base of the ion generator.

The copper discharge electrodes 6 may be formed by etching a portion of a copper plate formed on a surface of the plastic plate 2. The copper discharge electrodes 6 may be formed on a portion of a surface of the plastic plate 2. The copper discharge electrodes 6 may have a high-density shape. Each copper discharge electrode 6 may include a first discharge electrode part and a second discharge electrode part spaced apart from the first discharge electrode and positioned to surround the first discharge electrode part. The first discharge electrode part and the second discharge electrode part each may include a discharge needle. Each copper discharge electrode 6 may further include a discharge electrode part connection connecting the first discharge electrode part with the second discharge electrode part. A plurality of copper discharge electrodes 6 may be formed on a single plastic plate 2. The plurality of copper discharge electrodes 6 may be formed on a surface of the plastic plate 2 to be spaced apart from each other. Some of the plurality of copper discharge electrodes 6 may be positive ion copper discharge electrodes 6A generating positive ions, and the others of the plurality of copper discharge electrodes 6 may be negative ion copper discharge electrodes 6B generating negative ions. Some of the plurality of copper discharge electrodes may be connected in series with each other, and the others thereof may be connected in series with each other. Four copper discharge electrodes 6 may be formed on a surface of the plastic plate 2, and two of the four copper discharge electrodes 6 may be positive ion copper discharge electrodes 6A, and the other two may be negative ion copper discharge electrodes 6B. When the positive ion copper discharge electrodes 6A and the negative ion copper discharge electrodes 6B are distinctively described, the term "positive ion copper discharge electrodes 6A" and the term "negative ion copper discharge electrodes 6B" are individually used while the term "copper discharge electrodes 6" is used in describing the common configurations and operations. The positive ion copper discharge electrodes 6A and the negative ion copper discharge electrodes 6B may be arranged along a line on the plastic plate 2, and one of the positive ion copper discharge electrodes 6A and one of the negative ion copper discharge electrodes 6B, which are closest to each other may be spaced apart from each other at the optimal distance.

The ground electrodes 8 may be formed on an opposite surface of the plastic plate 2 to respectively correspond to the copper discharge electrodes 6. The ground electrodes 8 may be formed by etching like the copper discharge electrodes 6. The ground electrodes 8 may be formed by etching a portion of a copper plate formed on the opposite surface of the plastic plate 2. The ground electrodes 8 may also be formed on the plastic plate 2 by printing unlike the copper discharge electrodes 6. The ground electrodes 8 may be formed on a portion of the opposite surface of the plastic plate 2. Each ground electrode 8 may include a first ground electrode part and a second ground electrode part spaced apart from the first ground electrode and positioned to surround the first ground electrode part. Each ground electrode 8 may further include a ground electrode part connection connecting the first ground electrode part with the second ground electrode part. When a plurality of copper discharge electrodes 6 are formed on a surface of a single plastic plate 2, a plurality of ground electrodes 8 may be formed on an opposite surface of the plastic plate 2 so that the number of the copper discharge electrodes 6 corresponds to the number of the ground electrodes 8. In case four copper discharge electrodes 6 are formed on a surface of the plastic plate 2 to be spaced apart from each other, four ground electrodes 8 may be formed on an opposite surface of the plastic plate 2 to be spaced apart from each other.

The ion generator may further include a coating layer 12 formed on a surface of the plastic plate 2 around the copper discharge electrodes 6. The coating layer 12 may be a protection layer that protects a surface of the plastic plate 2 where the copper discharge electrodes 6 are not positioned. The coating layer 12 may be formed around the copper discharge electrodes 6 on a surface of the plastic plate 2 by printing. The coating layer 12 may be disposed to surround outer edges of the copper discharge electrodes 6.

The metal coating layer 10 is an anti-oxidization coating layer to prevent the copper discharge electrodes 6 from being oxidized and may be formed of gold. The metal coating layer 10 may be coated to surround all of the externally exposed portions of the copper discharge electrodes 6. The metal coating layer 10 may be formed on the copper discharge electrodes 6 after the coating layer 12 is formed on a surface of the plastic plate 2. In such case, portions of the outer edges 7 of the copper discharge electrodes 6 may be surrounded by the coating layer 12, and the rest of the outer edges 7 of the copper discharge electrodes 6 may be surrounded by the metal coating layer 10.

The ion generator may be configured so that all of the opposite surface of the plastic plate 2 and the ground electrodes 8 may be coated by a coating layer 14 The ion generator may be configured so that a portion of the opposite surface of the plastic plate 2, other than the ground electrodes 8, may be coated by the coating layer 14, and the ground electrodes 8 may be coated by a metal coating layer 16 to prevent the ground electrodes 8 from being oxidized.

The plastic plate 2, the copper discharge electrodes 6, and the ground electrodes 8, together with the metal coating layer 10 coated on the copper discharge electrodes 6, may form an ion generating module.

The plastic plate 2, the copper discharge electrodes 6, and the ground electrodes 8, together with the metal coating layer 10 coated on the copper discharge electrodes 6 and the coating layer 12 formed on a surface of the plastic plate 2, may form an ion generating module.

The plastic plate 2, the copper discharge electrodes 6, and the ground electrodes 8, together with the metal coating layer 10 coated on the copper discharge electrodes 6, the coating layer 12 formed on a surface of the plastic plate 2, and the coating layer 14 formed on an opposite surface of the plastic plate 2, may form an ion generating module.

The plastic plate 2, the copper discharge electrodes 6, and the ground electrodes 8, together with the metal coating layer 10 coated on the copper discharge electrodes 6, the coating layer 12 formed on a surface of the plastic plate 2, and the metal coating layer 16 coated on the ground electrodes 8, may form an ion generating module.

The plastic plate 2, the copper discharge electrodes 6, and the ground electrodes 8, together with the metal coating layer 10 coated on the copper discharge electrodes 6, the coating layer 12 formed on a surface of the plastic plate 2, the coating layer 14 formed on an opposite surface of the plastic plate 2, and the metal coating layer 16 coated on the ground electrodes 8, may form an ion generating module.

FIG. 4 is a perspective view illustrating an ion generator according to an embodiment of the present invention. FIG. 5 is a view illustrating a high voltage generator as shown in FIG. 4.

The ion generator may include an ion generating module A, a high voltage generator B applying a high voltage to the ion generating module A, and a housing C in which the ion generating module A and the high voltage generator B are installed.

The ion generating module A may be connected with the high voltage generator B via an electric line L, and when applied with a high voltage from the high voltage generator B, may generate ions.

The high voltage generator B may include a printed circuit board B1 and a coiled winding-type transformer formed on the printed circuit board B1. The high voltage generator B may further include a transformer housing B2 surrounding the winding-type transformer. The winding-type transformer may be surrounded by the transformer housing B2 to be not exposed to the outside, thus increasing the reliability of the high voltage generator B. The transformer housing B2 may be formed on the printed circuit board B1 and may have a space therein to accommodate the winding-type transformer.

The housing C may include ion outlets C1 and C2 through which ions are discharged. A plurality of ion outlets C1 and C2 may be formed through the housing C. The ion outlets C1 and C2 may include a positive ion outlet C1 through which positive ions are discharged and a negative ion outlet C2 through which negative ions are discharged. The positive ion outlet C1 and the negative ion outlet C2 may be formed through the housing C to be spaced apart from each other.

FIG. 6 is a view illustrating the amount of ions generated from an ion generator according to an embodiment of the present invention.

FIG. 6 illustrates the amount of ions measured, with the number of the copper discharge electrodes 6 and the distance between the copper discharge electrodes 6 changed while other environments such as temperature, moisture, the measurement distance of ion meter, and wind speed remain constant. The result shown in FIG. 6 represents the amount of positive ions and negative ions measured in a 12 m3 chamber under the environment where the temperature is 20° C., the humidity is 40%, the distance between the ion meter and the ion generator is lm, and the wind speed is 1.0 m/s.

(A) of FIG. 6 shows the amount of positive ions and negative ions generated from the ion generator in which one positive ion copper discharge electrode and one negative ion copper discharge electrode are spaced apart from each other at 32 mm on a 22×56 mm size plastic plate 2.

(B) of FIG. 6 shows the amount of positive ions and negative ions generated from the ion generator in which three negative ion copper discharge electrodes are spaced apart from each other at 16.5 mm on a 22×56 mm size plastic plate 2.

(C) of FIG. 6 shows the amount of positive ions and negative ions generated from the ion generator in which two positive ion copper discharge electrodes and two negative ion copper discharge electrodes are formed on a 22×56 mm size plastic plate 2, and the plurality of copper discharge electrodes are spaced apart from each other at 13 mm.

(D) of FIG. 6 shows the amount of positive ions and negative ions generated from the ion generator in which two positive ion copper discharge electrodes and two negative ion copper discharge electrodes are formed on a 22×56 mm size plastic plate 2, and the plurality of copper discharge electrodes are spaced apart from each other at 13 mm.

The ion generator may generate more positive ions and negative ions when the distance between the plurality of copper discharge electrodes is 21.42% to 23.21% of the longitudinal-direction length of a rectangular plastic plate 2, and the distance between the plurality of copper discharge electrodes of the ion generator is preferably less than 50% of the longitudinal-direction length of the rectangular plastic plate 2. It may be most preferred that the distance between the plurality of copper discharge electrodes of the ion generator may be 21.42% to 23.21% of a length of the rectangular plastic plate 2.

FIG. 7 is a flowchart illustrating a method of manufacturing an ion generator according to an embodiment of the present invention. FIG. 8 is a view illustrating a process of manufacturing an ion generator according to an embodiment of the present invention.

The method of manufacturing an ion generator according to the present invention may include the step S1 of forming copper discharge electrodes 6 by etching a portion of a copper plate 5 formed on a plastic plate 2 as shown in FIGS. 7 and 8. In the method of manufacturing an ion generator, as shown in FIG. 8(*a*), a pattern of the copper discharge electrodes 6 may be marked on the plastic plate 2 having the copper plate 5 formed on a surface thereof, and the rest of a portion that is to be left as the pattern of the copper discharge electrodes 6 may be etched out. In such case, the remaining non-etched portion of the copper plate 5 formed on a surface of the plastic plate 2 may be left on the plastic plate 2 as shown in FIG. 8(*b*), and this portion may become the copper discharge electrodes 6.

The method of manufacturing an ion generator includes the step S2 of forming a coating layer 12 by ink-coating a portion of the plastic plate 2 surrounding the copper discharge electrodes 6 as shown in FIGS. 7 and 8. In the method of manufacturing an ion generator, the portion etched out in the previous step may be coated with an ink, and the ink may be placed around the copper discharge electrodes 6 as shown in FIG. 8(*c*) to surround the outer edges 7 of the copper discharge electrodes 6. A coating layer 12 may be formed around the copper discharge electrodes 6 to surround the portion of the plastic plate 2 other than the copper discharge electrodes 6.

The method of manufacturing an ion generator may include the step S3 of coating the copper discharge electrodes 6 with a metal coating layer 10 as shown in FIGS. 7 and 8. The metal coating layer 10 may be formed of gold, and the gold may be coated by various coating methods such as printing or spraying. The metal coating layer 10 coated on the copper discharge electrodes 6 may surround the copper discharge electrodes 6 as shown in FIG. 8(*d*).

The method of manufacturing an ion generator may include the step S4 of drying the ion generator having the metal coating layer 10 coated on the copper discharge electrodes 6. In the step S4 of drying the ion generator, the ion generator having the metal coating layer 10 coated may be dried at a high temperature of about 150° C.

FIG. 9 is a cross-sectional view illustrating an ion generator according to another embodiment of the present invention.

In this embodiment, the ion generator may further include a photo catalyst coating layer 20 coated on the coating layer 12. Other configurations and operations than the photo catalyst coating layer 20 are the same or similar to those of the ion generator according to the above embodiment, and thus, the same reference denotations are used and detailed description thereof is skipped.

The photo catalyst coating layer 20 includes a photo catalyst that receives light to prompt a chemical reaction and may oxidation-decompose harmful substances. The photo catalyst in the photo catalyst coating layer 20 may include titanium oxide (TiO2), and the photo catalyst coating layer 20 may be a titanium oxide coating layer. The photo catalyst in the photo catalyst coating layer 20 may be dry-coated or wet-coated on the coating layer 12.

When a high voltage is applied to the copper discharge electrodes 6 to create a plasma discharge, ultraviolet (UV) rays are generated. The generated UV rays may be radiated to the photo catalyst coating layer 20. The photo catalyst coating layer 20 may be activated by the UV rays, thus creating radicals and ions. The radicals and ions may prompt oxidization of organic materials to assist in sterilization and deodorization.

FIG. 10 is a view illustrating the sterilization capability of an ion generator according to another embodiment of the present invention.

FIG. 10 shows the experimental results of sterilization rates (%) obtained for each of the case (No coating) where no photo catalyst coating layer 20 is formed on the coating layer 12 of the ion generator, the case (Wet coating) where the photo catalyst coating layer 20 is wet-coated on the coating layer 12 of the ion generator, and the case (Dry coating) where the photo catalyst coating layer 20 is dry-coated on the coating layer 12 of the ion generator. The experimental results are the ones obtained by conducting the experiments in a 1 m3 space for five minutes while other factors than the presence or absence of the photo catalyst coating layer 20 and the coating methods remain the same.

In the case where the photo catalyst coating layer 20 is formed on the coating layer 12, about 83% of colon bacilli were removed whereas in the case where no photo catalyst coating layer 20 is formed on the coating layer 12, about 70.9% of colon bacilli were removed. Accordingly, it could be verified that more capability of removing colon bacilli is shown when the photo catalyst coating layer 20 is formed on the coating layer 12 is higher than when no photo catalyst coating layer 20 is formed on the coating layer 12.

FIG. 11 is a flowchart illustrating a method of manufacturing an ion generator according to another embodiment of the present invention.

As shown in FIG. 11, a method of manufacturing an ion generator according to this embodiment includes the step S1 of forming copper discharge electrodes 6 by etching a portion of a copper plate formed on a plastic plate 2; the step S2 of forming a coating layer 12 by ink-coating a portion around the copper discharge electrodes 6; the step S3 of coating the copper discharge electrodes 6 with a metal coating layer 10; the step S4 of drying the ion generator; and the step S5 of coating a photo catalyst on the coating layer 20.

Other configurations and operations than the step S5 of coating the photo catalyst on the coating layer 20 are the same or similar to those of the method of manufacturing an ion generator according to the above embodiment, and detailed description thereof is skipped.

The step S5 of coating the photo catalyst on the coating layer 20 is performed by wet-coating the photo catalyst on the coating layer 12 or by dry-coating the photo catalyst on the coating layer 12.

In the wet-coating, the photo catalyst coating layer 20 may be coated on the coating layer 12 by soaking the coating layer 12 in an aqueous solution containing the photo catalyst, with the aqueous solution in a container. In another example of wet-coating, an aqueous solution containing the photo catalyst may be coated on the coating layer 12 by printing.

Meanwhile, the dry-coating may be performed by sputtering the photo catalyst on the coating layer 12.

Meanwhile, the present invention is not limited to the above-described embodiments, and various changes may be made thereto without departing from the technical scope of the present invention.

The invention claimed is:

1. An ion generator, comprising: a plastic plate; a copper discharge electrode formed on a first surface of the plastic plate, the copper discharge electrode having at least one discharge needle; a ground electrode formed on an opposite surface of the plastic plate; and a metal coating layer coated on the copper discharge electrode.

2. The ion generator of claim 1, wherein the plastic plate is formed of epoxy resin.

3. The ion generator of claim 1, wherein the metal coating layer is formed of gold.

4. The ion generator of claim 1, wherein the copper discharge electrode is formed on a portion of the first surface of the plastic plate, and the ground electrode is formed on a portion of the opposite surface of the plastic plate.

5. The ion generator of claim 4, further comprising a coating layer formed on a portion around the copper discharge electrode on the first surface of the plastic plate.

6. The ion generator of claim 5, further comprising a photo catalyst coating layer coated on the coating layer.

7. An ion generator, comprising an ion generating module, a high voltage generator applying a high voltage to the ion generating module, and a housing in which the ion generating module and the high voltage generator are installed, wherein the ion generating module comprises: a plastic plate; a copper discharge electrode formed on a first surface of the plastic plate, the copper discharge electrode having at least one discharge needle; a ground electrode formed on an opposite surface of the plastic plate; and a metal coating layer coated on the copper discharge electrode, and wherein the high voltage generator comprises a printed circuit board, a winding-type transformer formed on the printed circuit board, and a transformer housing formed on the printed circuit board and surrounding the winding-type transformer.

8. The ion generator of claim 7, wherein the plastic plate is formed of epoxy resin.

9. The ion generator of claim 7, wherein the metal coating layer is formed of gold.

10. The ion generator of claim 7, wherein the copper discharge electrode is formed on a portion of the first surface of the plastic plate, and the ground electrode is formed on a portion of the opposite surface of the plastic plate.

11. The ion generator of claim 10, further comprising a coating layer formed around the copper discharge electrode on the first surface of the plastic plate.

12. The ion generator of claim 11, further comprising a photo catalyst coating layer coated on the coating layer.

13. A method of manufacturing an ion generator, the method comprising the steps of: forming a copper discharge electrode by etching a portion of a copper plate formed on a plastic plate; forming a coating layer by ink-coating a portion around the copper discharge electrode; and coating a metal coating layer on the copper discharge electrode.

14. The ion generator of claim 13, further comprising: drying the ion generator; and coating a photo catalyst on the coating layer.

15. The ion generator of claim 14, wherein the step of coating the photo catalyst is wet-coating the photo catalyst on the coating layer.

16. The ion generator of claim 14, wherein the step of coating the photo catalyst is dry-coating the photo catalyst on the coating layer.

* * * * *